US006651466B1

(12) United States Patent
Shih

(10) Patent No.: US 6,651,466 B1
(45) Date of Patent: Nov. 25, 2003

(54) DUAL LOCK ASSEMBLY WITH A DIRECTION-CHANGEABLE LATCH BOLT

(76) Inventor: Simon Shih, 116, Chang Tsao Road, Chang Hua City (TW)

( * ) Notice: Subject to any disclaimer, the term of this patent is extended or adjusted under 35 U.S.C. 154(b) by 0 days.

(21) Appl. No.: 09/414,644

(22) Filed: Oct. 8, 1999

(30) Foreign Application Priority Data

May 17, 1999 (TW) ..... 88207973 U

(51) Int. Cl.[7] ..... E05B 59/00

(52) U.S. Cl. ..... 70/107; 70/134; 70/462; 292/34; 292/165

(58) Field of Search ..... 70/107, 110, 111, 70/134, 150, 151 R, 467, 470, 472, 478, 462; 292/336.3, 34, 165

(56) References Cited

U.S. PATENT DOCUMENTS 1,553,532 A * 9/1925 Hoffman ..... 70/107 X
1,721,676 A * 7/1929 Thelenz ..... 70/107 X
2,029,991 A * 2/1936 Eichel ..... 70/107
3,769,822 A * 11/1973 Yulkowski ..... 70/107
3,892,110 A * 7/1975 Poli ..... 70/107
4,583,382 A * 4/1986 Hull ..... 70/107
5,027,625 A * 7/1991 Krachten ..... 70/107
5,265,920 A * 11/1993 Kaup et al. ..... 292/40
6,050,115 A * 4/2000 Schroter et al. ..... 70/107
6,302,456 B1 * 10/2001 Errani ..... 292/332

FOREIGN PATENT DOCUMENTS

WO 99/25943 * 5/1999 ..... 70/107 X

* cited by examiner

*Primary Examiner*—Suzanne Dino Barrett
(74) *Attorney, Agent, or Firm*—Larson & Taylor, PLC

(57) ABSTRACT

A dual lock system includes a housing for enclosing an actuating mechanism, a latch bolt, a dead bolt, a stop block, a lock core, and a safe therein. Upper and lower openings are provided in a faceplate to allow extension and retraction of the latch bolt and the dead bolt. Two upper actuating plates are pivotable by operation of the inside handle and the outside handle, respectively. When the dual lock assembly is in a locked status, rotation of the inside handle is allowed to simultaneously retract the deadbolt and the latch bolt, yet rotation of the outside handle is prohibited by a stop piece of the stop block. The latch bolt can be rotated through 180° when extended.

14 Claims, 5 Drawing Sheets

DUAL LOCK ASSEMBLY WITH A DIRECTION-CHANGEABLE LATCH BOLT

BACKGROUND OF THE INVENTION

1. Field of the Invention

The present invention relates to a dual lock assembly with simultaneous retraction of a latch bolt and deadbolt by an inside lever handle. The present invention also relates to a dual lock with a latch bolt that can be inverted in response to either a left-handed door or a right-handed door.

2. Description of the Related Art

FIG. 8 of the drawings illustrates a lock assembly including a latch bolt 14' that can be retracted by rotation of inside or outside handle 11' and an auxiliary lock 12' having a dead bolt 15' that can be retracted by an inside turnknob 16' or by a proper key from outside. When in an emergency, one has to turn the turnknob 16' first and then turn the inside handle. This is inconvenient and sometimes causes deadly delay.

SUMMARY OF THE INVENTION

It is a primary object of the present invention to provide a dual lock assembly that includes a latch bolt and a deadbolt which can be simultaneously unlatched by simple operation of the inside handle, rotation of the turnknob, or by a proper key.

It is another object of the present invention to provide a dual lock assembly having a latch bolt that can be inverted in response to either a left-handed door or a right-handed door.

The dual lock system in accordance with the present invention includes two upper actuating plates that are respectively pivoted under operation of the inside handle and outside handle to drive a lower actuating plate. A stop block has a stop piece for preventing rotation of the lower actuating plate. Namely, the deadbolt and the latch bolt can be retracted by rotation of the inside handle when the dual lock system is in a locked status, while preventing rotation of the outside handle. The latch bolt can be rotated through 180° so as to be used in either left-handed or right-handed door.

Other objects, specific advantages, and novel features of the invention will become more apparent from the following detailed description and preferable embodiments when taken in conjunction with the accompanying drawings.

DETAILED DESCRIPTION OF THE PREFERRED EMBODIMENTS

Figure 1:
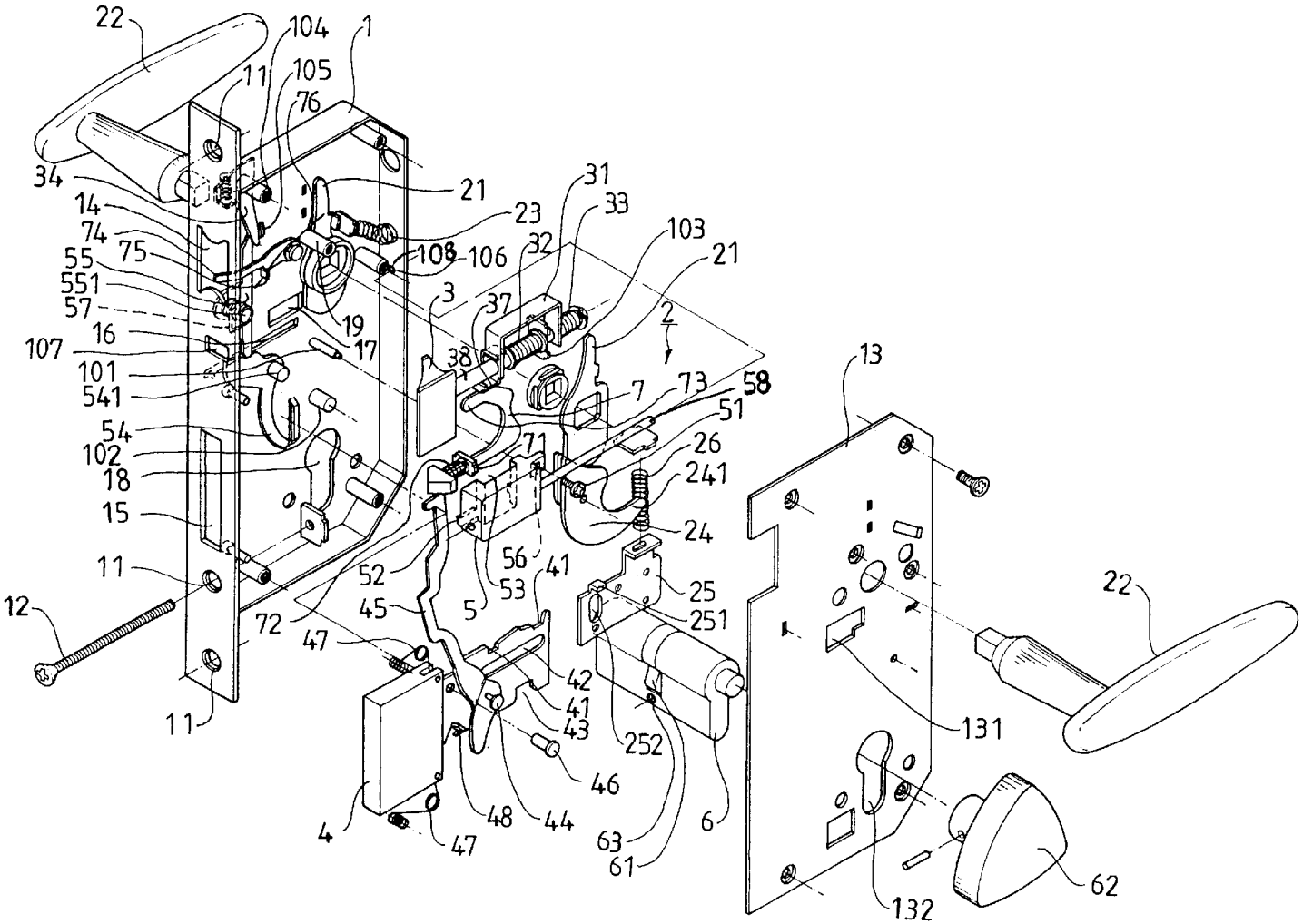
FIG. 1 is an exploded perspective view of a dual lock assembly in accordance with the present invention.
Figure 2:
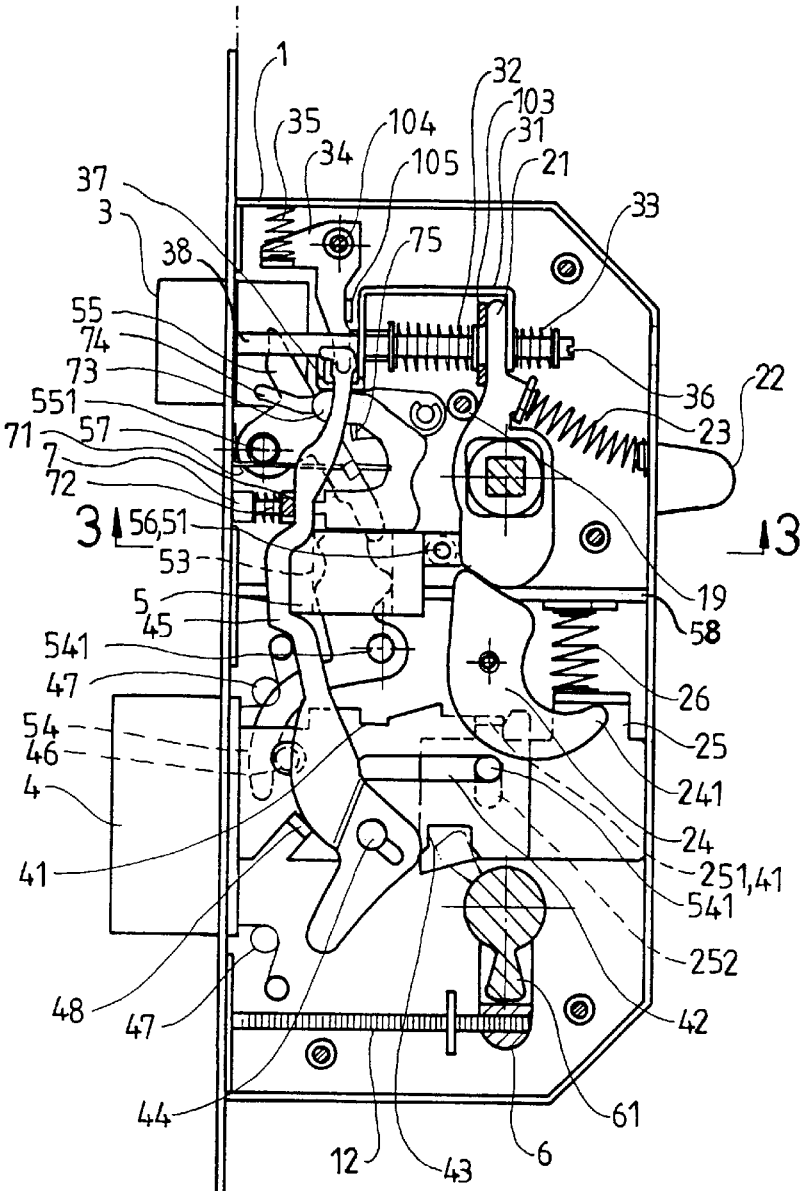
FIG. 2 is a front view of the dual lock assembly in accordance with the present invention.

Referring to FIGS. 1 and 2, a dual lock assembly in accordance with the present invention generally includes a housing 1 for accommodating an actuating mechanism 2, a latch bolt 3, a deadbolt 4, a stop block 5, a lock core 6, and a safe 7. The housing 1 includes a side wall with positioning holes 11 through which fasteners 12 are extended to secure the housing 1 to a doorplate. After accommodating the above-mentioned components in the housing 1, a plate 13 is provided for enclosure. The housing 1 includes a latch bolt opening 14 and a deadbolt opening 15 through which the latch bolt 3 and the deadbolt 4 extend/retract, respectively. The housing 1 further includes a rectilinear slot 16 for guiding rectilinear movement of the stop block 5. The housing 1 and the plate 13 include aligned windows 17 and 131 through which a stop piece 51 is passable so as to be optionally secured to one of two sides of the stop block 5. The housing 1 and the plate 13 further include aligned slots 18 and 132 for positioning the lock core 6.

The drive mechanism 2 includes two upper actuating plates 21 operably connected to an inside handle 22 and an outside handle 22, respectively. An elastic element 23 is provided to return the respective actuating plate 21 after rotation of the actuating plate 21. The respective actuating plate 21 bears against a post 19 and thus is stopped during its returning movement. During rotation of the actuating plate 21, the latchbolt 3 is retracted and a lower actuating plate 24 is driven to rotate about a peg 101 on the housing 1. A hook 241 on the lower actuating plate 24 moves upward to push a catch plate 25 upward during rotation of the lower actuating plate 24. A catch 251 on the catch plate 25 is moved upward and thus disengaged from an engaging notch 41 of the deadbolt 4. In addition, when driving force from the lower actuating plate 24 disappears, the catch plate 25 is returned by an elastic element 26, thereby causing the catch 251 to engage with one of two engaging notches 41 of the deadbolt 4. The catch plate 25 includes a slot 252 mounted around a peg 102 on the housing 1 to allow rectilinear movement of the catch plate 25.

Figure 3:
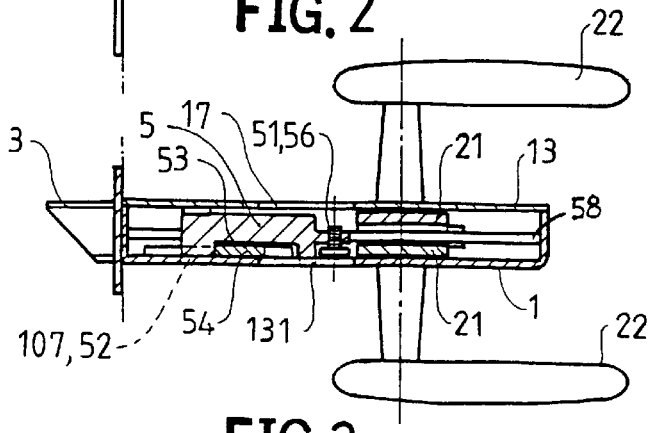
FIG. 3 is a sectional view taken along line 3—3 in FIG. 2.
Figure 7:
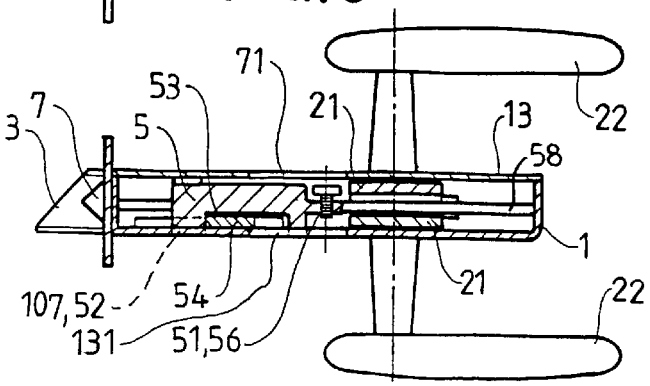
FIG. 7 is a sectional view taken along line 7—7 in FIG. 6.
Figure 8:
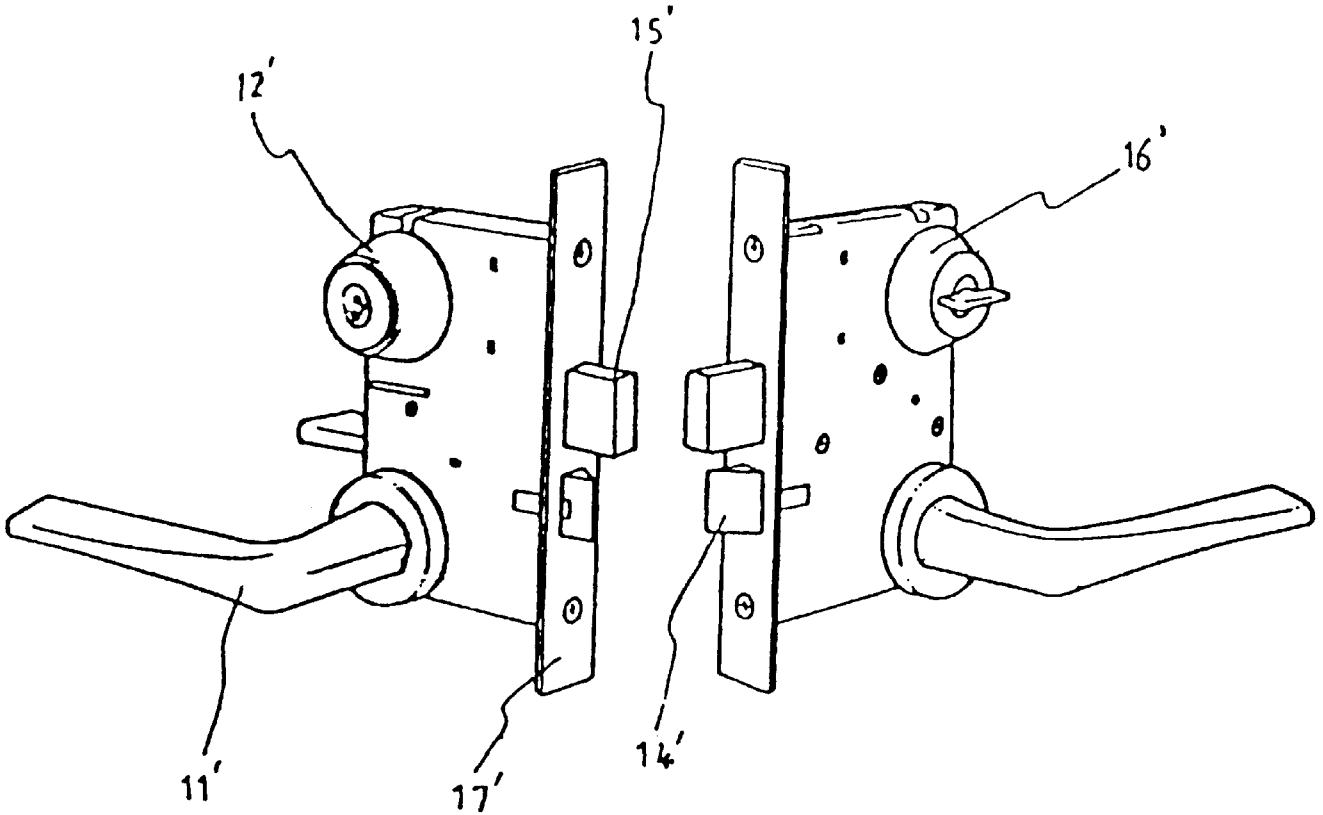
FIG.8 PRIOR ART
FIG. 8 is an exploded perspective view of a conventional door lock assembly.

The latch bolt 3 moves rectilinearly by provision of the latch bolt opening 14 and a guide plate 103 secured to the housing 1 and the plate 13. A substantially U-shape plate 31 includes an end actuatable by the upper actuating plate 21 to urge a rod 38 extended from the latch bolt 3 to retract, thereby retracting the latch bolt 3 into the housing 1. Elastic elements 32 and 33 are provided to return the latch bolt 3. During returning of the latch bolt 3 (namely, the latch bolt 3 is extended outside the latch bolt opening 4 and the U-shape plate 31 bears against a compression plate 34), the compression plate 34 pivots about a pivotal member 104 until it is stopped by a stop 105, as the compression plate 34 is biased by an elastic member 35 having an elastic coefficient greater than that of the elastic elements 32 and 33. Thus, when the latch bolt 3 is returned under action of the elastic elements 32 and 33, the latch bolt 3 is stopped when the U-shape plate 31 and the compression plate 34 contact with each other. At this time, the latch bolt 3 is not completely beyond the latch bolt opening 14. The rod 38 of the latch bolt 3 further includes a slot 36 such that a tool, e.g., a screwdriver may be used to push and rotate the rod 38. When the latch bolt 3 is pushed by a tool, the compression plate 34 is forced to pivot, thereby urging the latch bolt 3 to pass through the latch bolt opening 14 completely. Thus, the latch bolt 3 is capable of being rotated through 180° by means of driving the latch bolt 3 by the tool, as shown in FIGS. 3 and 7.

The deadbolt 4 moves rectilinearly by provision of the peg 102 on the housing 1 and the deadbolt opening 15. The deadbolt 4 includes a notch 43 that is engagable with and thus driven by a drive block 61 of the lock core 6. The deadbolt 4 further includes two engaging notches 41. When the deadbolt 4 is moved to its locked position, one of the engaging notches 41 is engaged with the catch 251 of the catch plate 25, thereby retaining the deadbolt 4 in place. The deadbolt 4 is in pivotal connection with a follower plate 45 by a pivotal member 44. An end of the follower plate 45 is engaged on an engaging notch 37 of the latch bolt 3. Thus, retraction of the deadbolt 4 under actuation of the lock core 6 also causes retraction of the latch bolt 3. The deadbolt 4 further includes a protruded peg 46 that is operably connected to a return follower plate 54 driven by the stop block 5, thereby allowing transmission therebetween. An elastic element 47 is provided to bias the deadbolt 4 to extend beyond the deadbolt opening 15.

The stop block 5 includes a through-hole 56 to allow the stop piece 51 to be optionally secured to one of two sides of the stop block 5. The stop piece 51 is provided to stop rotation of one of the actuating plates 21. The stop block 5 includes a rod 58 that is guided by a hole 108 of the housing 1. The stop block 5 further includes a protrusion 52 that is slidably guided by a rectilinear slot 16 on the housing 1. Thus, the stop block S moves rectilinearly. The stop block 5 further includes a channel 53 for receiving the return follower plate 54 and an end of a drive plate 55. The return follower plate 54 includes a central fulcrum 541 that is pivotally mounted. An end of the return follower plate 54 is operably connected to the peg 46 of the deadbolt 4, thereby allowing transmission therebetween. The other end of the return follower plate 54 is operably connected to the drive plate 55. The return follower plate 54 and the drive plate 55 are restrained in the channel 53 of the stop block 5. The drive plate 55 is rotatable about its central fulcrum 551. An end of the drive plate 55 extends into the channel 53 and operably connected to an end of the return follower plate 54. An elastic element 57 is provided to the drive plate 55 for biasing the other end of the drive plate 55 to a position that allows retraction of the latch bolt 3. Thus, when the inside handle 22 is rotated to cause retraction of the latch bolt 3, the drive plate 55 urges the return follower plate 54 to rotate and causes the stop piece 51 of the stop block 5 to move away from the upper actuating plate 21 for the outside handle 22, thereby accomplishing the unlatching function. In the mean time, the other end of the return follower plate 54 bears against the peg 46 to cause synchronous retraction of the deadbolt 4 for unlatching.

The lock core 6 includes two exposed ends that are respectively secured in the positioning slot 18 of the housing 1 and the positioning slot 132 of the plate 13. A proper key may be inserted into a keyway (not shown) in an end of the lock core 6 and then rotated for unlatching. The other end of the lock core 6 is engaged with a turnknob 62 for direct rotation of the drive block 61 upon manual operation. Orientation of the keyway can be changed after detaching the plate 13. Namely, the keyway can be positioned adjacent to the housing 1 or the plate 13 such that the keyway always faces outward and that the turnknob 62 is located indoors. Screw holes 63 are provided to allow extension of fasteners 12 for securing the lock core 6 in place.

The safe 7 includes a fixing plate 71 secured to the housing 1. An end of the safe 7 is biased by an elastic element 72 and thus extends beyond a hole 107 of the housing 1. The other end of the safe 7 includes a hook 73 that is operably connected to a protrusion 75 of a safe piece 74 which, in turn, is pivotally connected to the housing 1. An end of the safe piece 74 is pivoted to the housing 1 and biased by an elastic element 76 to urge the other end of the safe piece 74 to a position for obstructing retraction of the latch bolt 3. When the dual lock assembly is mounted to a doorplate and the doorplate is in a closed status, the protruded safe 7 is moved into the housing 1 such that the safe piece 74 is biased by the elastic element 76 to a position for obstructing retraction of the latch bolt 3. Thus, retraction of the latch bolt 3 is not allowed. In addition, unauthorized opening of the door by means of forcibly exerting an inward force to the latch bolt 3 is prevented. An upper end of the safe piece 74 is operably connected to a bottom of the engaging notch 37 of the latch bolt 3. When the U-shape plate 31 on the latch bolt 3 is pulled inward, the safe piece 74 is moved downward by the bottom of the engaging notch 37.

FIGS. 2 and 3 illustrate an application of the dual lock assembly of the invention, wherein the latch bolt 3 and the deadbolt 4 are in extended positions (latching positions). Elastic elements 32 and 33 cause extension of the latch bolt 3. Extension of the deadbolt 4 is caused by use of a proper key or rotation of the turnknob 62 and via transmission of the drive block 61 that engages with the notch 43 of the deadbolt 4. During extension of the deadbolt 4, the peg 46 of the deadbolt 4 causes rotation of the return follower plate 54 to pivot about its central fulcrum 541. The return follower plate 54 actuates the drive plate 55 and the stop block 5. The stop piece 51 of the stop block 5 is moved to a position close to the upper actuating plate 21 for the outside handle 22, thereby preventing rotation of the outside handle 12. Meanwhile, the other end of the drive plate 55 is moved to a position for obstructing retraction of the latch bolt 3. In addition, the safe 7 is moved inward by the door frame such that the distal end of the safe piece 74 is moved to a position for obstructing retraction of the latch bolt 3. Thus, the intention of unauthorized opening of the door by means of forcibly exerting an inward force to the latch bolt 3 by a tool is prevented. This is because the U-shape plate 31 on the latch bolt 3 is not moved such that retraction of the latch bolt 3 is stopped by the safe piece 74.

Figure 4:
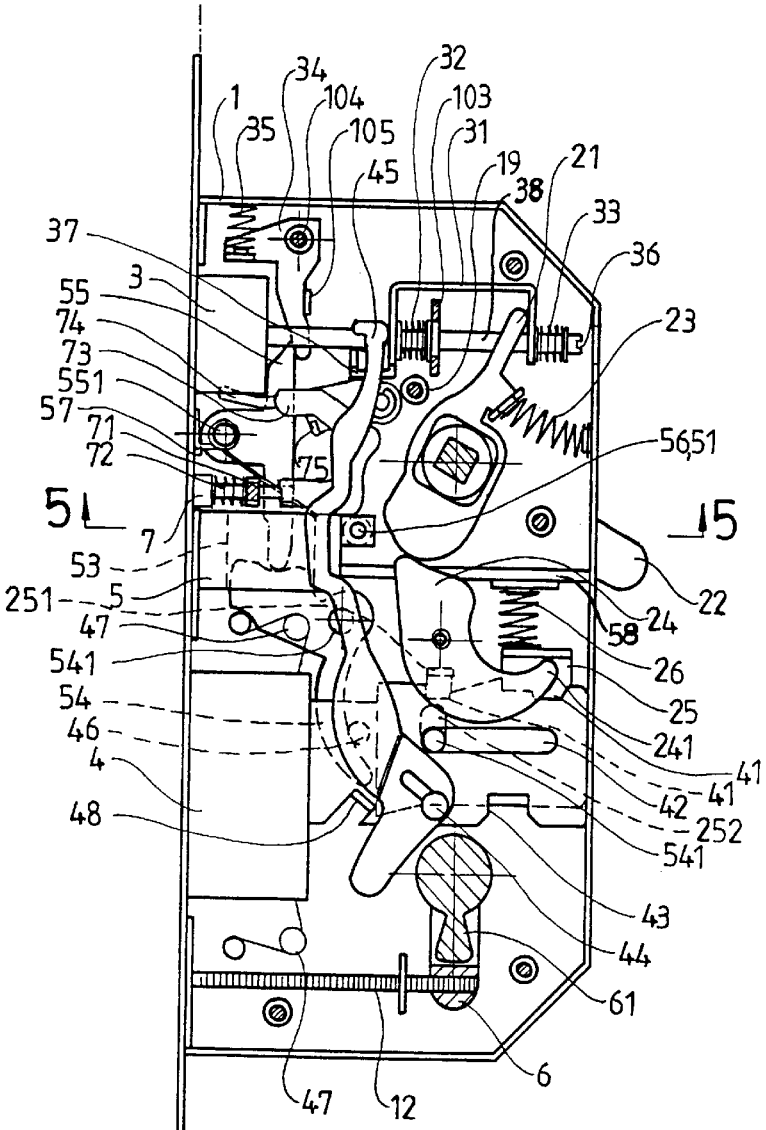
FIG. 4 is a view similar to FIG. 2, illustrating retraction of the deadbolt and the latch bolt.
Figure 5:
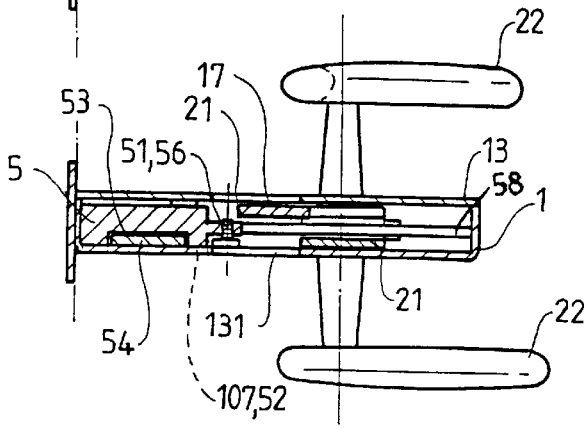
FIG. 5 is a sectional view taken along line 5—5 in FIG. 4.

Referring to FIGS. 4 and 5, when the inside handle 22 is rotated, the upper actuating plate 21 for the inside handle 22 urges the U-shape plate 31 on the latch bolt 3 to move along the rod 38 of the latch bolt 3 and thus compresses the elastic elements 32 and 33. Movement of the U-shape plate 31 causes downward movement of the safe piece 74. In addition, the upper actuating plate 21 urges the lower actuating plate 24 to rotate such that the hook 241 of the lower actuating plate 24 pushes the catch plate 25 upward, thereby causing disengagement of the catch 251 from the engaging notch 41. Further rotation of the upper actuating plate 21 causes retraction of the latch bolt 3. It is noted that the safe piece 74 has been moved to a position not obstructing retraction of the latch bolt 3. Retraction of the latch bolt 3 also causes the other end of the drive plate 55 to actuate the return follower plate 54 and the stop block 5. The stop piece 51 of the stop block 5 is moved to a position not obstructing rotation of the upper actuating plate 21 for the outside handle 22. In addition, the return follower plate 54 actuates the peg 46 of the deadbolt 4 to cause simultaneous retraction of the deadbolt 4 into the housing 1.

Still referring to FIGS. 2 and 3 that show the latching status of the dual lock assembly, when a proper key is used or the turnknob 62 is rotated, the drive block 61 of the lock core 6 is rotated to move the catch plate 25 upward such that the catch 251 disengages from the engaging notch 41 of the deadbolt 4. In addition, the drive block 61 is engaged with the notch 43 of the deadbolt 4 to cause retraction of the deadbolt (FIG. 4). During retraction of the deadbolt 4, the follower plate 45 is restrained by the pivotal member 44 and the protrusion 48 such that the upper end of the follower plate 45 causes the U-shape plate 31 on the latch bolt 3 to retract, thereby retracting the latch bolt 3.

Figure 6:
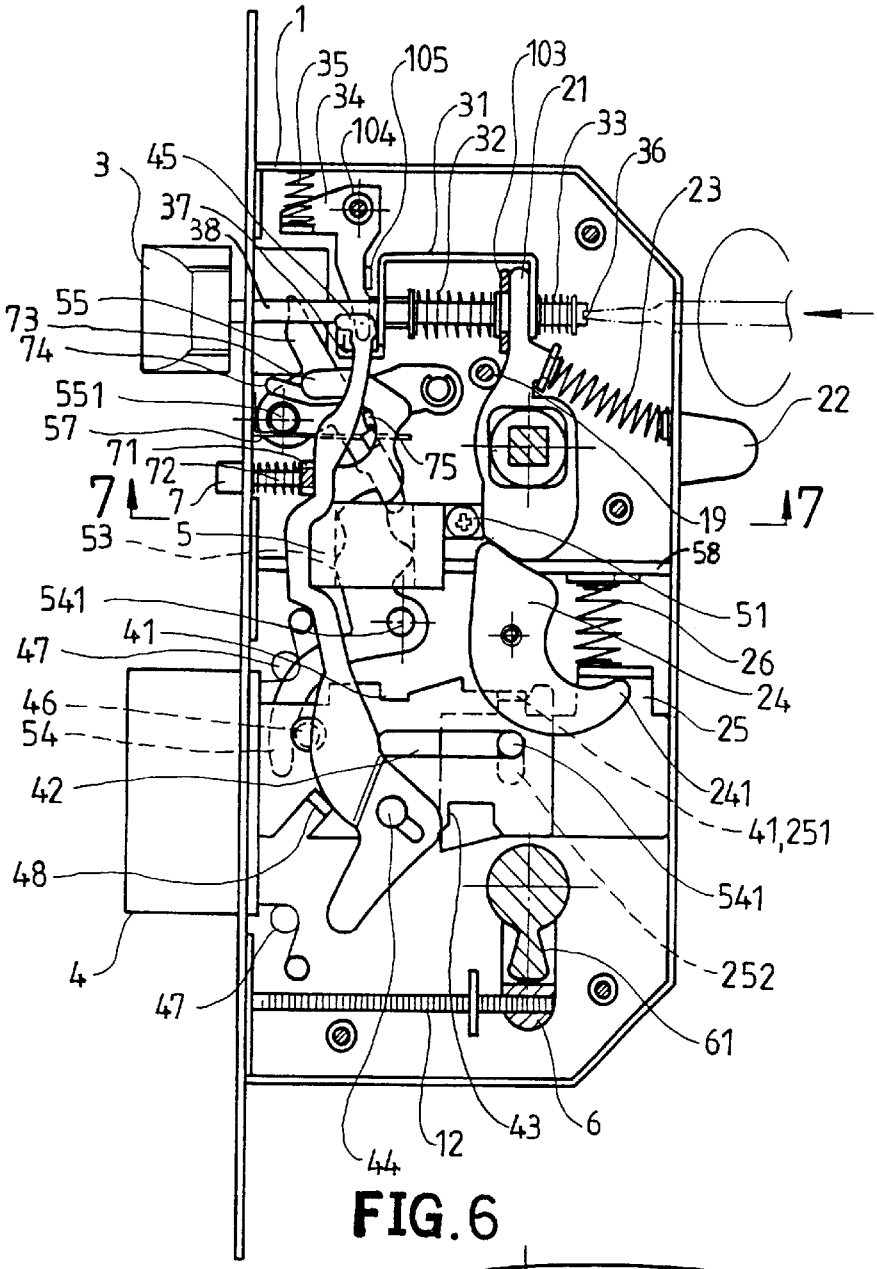
FIG. 6 is a view similar to FIG. 2, wherein the latch bolt is inverted.

Referring to FIGS. 6 and 7, when the dual lock assembly requires adjustment in response to the need for a left-handed door or a right-handed door, the fasteners 12 for positioning the lock core 6 are detached to allow a change in the orientation of the lock core 6 in a manner that the turnknob 62 locates indoors. In addition, the stop piece 51 is engaged with the through-hole 56 of the stop block 5, and a screwdriver is engaged in the slot 36 of the latch bolt 3 and pushes the latch bolt 3, thereby causing the latch bolt 3 to disengage from the side wall of the housing 1. Thus, the latch bolt 3 is allowed to rotate through 180° such that the inclined face (not labeled) of the latch bolt faces the doorframe. Accordingly, the dual lock assembly of the invention can be adjusted and thus used to either left-handed or right-handed door.

According to the above description, it is appreciated that synchronous retraction of the latch bolt and the deadbolt can be achieved by rotation of the inside handle. In addition, the dual lock assembly of the invention can be adjusted and thus used to either left-handed or right-handed door.

Although the invention has been explained in relation to its preferred embodiment as mentioned above, it is to be understood that many other possible modifications and variations can be made without departing from the spirit and scope of the invention. It is, therefore, contemplated that the appended claims will cover such modifications and variations that fall within the true scope of the invention.

What is claimed is:

1. A dual lock assembly comprising:

a housing (1) and a plate (13) together accommodating a drive mechanism (2), a latch bolt (3), a deadbolt (4), a stop block (5), a lock core (6), and a safe (7) therein, the housing (1) including a latch bolt opening (14) through which the latch bolt (3) extends and retracts, the housing further including a deadbolt opening (15) through which the deadbolt (4) extends and retracts, the housing (1) including a first peg (102);

the drive mechanism (2) including:

a first upper actuating plate (21) adapted to be pivoted by rotation of an inside handle (22), a second upper actuating plate (21) adapted to be pivoted by rotation of an outside handle (22), a lower actuating plate (24) operably connected to the first upper actuating plate and the second upper actuating plate such that pivotable movement of one of the first upper actuating plate and the second upper actuating plate causes pivotal movement of the lower actuating plate, the lower actuating plate (24) including a hook (241);

a catch plate (25) operably connected to the lower actuating plate such that the catch plate (25) is moved upward by the hook (241) during pivotal movement of the lower actuating plate, the catch plate (25) including a catch (251), the catch plate further including a first slot (252) mounted around the first peg (102) of the housing (11), thereby being movable rectilinearly, and a first elastic element (26) for returning the catch plate (25), the latch bolt (3) including an extension rod (38) with a U-shape plate (31), the U-shape plate (31) being actuatable by the upper actuating plates (21), a second elastic element (32, 33) being mounted between the U-shape plate (31) and the extension rod (38), the latch bolt (3) further including a first notch (37);

the deadbolt (4) including two engaging notches (41) for optional engagement with the catch (251) of the catch plate (25), a follower plate (45) having an end in pivotal connection with the deadbolt (4), the other end of the follower plate (45) being engaged in the notch (37) of the latch bolt (3), the deadbolt (4) further including a second peg (46) and a second notch (43), the stop block (5) including a through-hole (56), a stop piece (51) being mounted to one of two sides of the stop block (56) via the through-hole (56), the stop block (5) further including a channel (53), a return follower plate (54) being received in the channel (53), a drive plate (55) including an end received in the channel (53), the return follower plate (54) and the drive plate (55) being operably connected to urge the stop block (5) to move rectilinearly, such that the stop piece (51) is moved toward or away from one of the upper actuating plates (21), the return follower plate (54) including a pivotally mounted central fulcrum (541), the return follower plate (54) further including an end that is operably connected to the second peg (46) of the deadbolt (4), the drive plate (55) including a pivotally mounted central fulcrum (551), the drive plate (55) further including an end that is biased by a third elastic element (57) to a position for obstructing retraction of the latch bolt (3), the drive plate (55) being pivotable by the latch bolt (3) that is being retracted;

the lock core (6) being secured to the housing (1) and including a first end with a keyway and a second end to which a turnknob (62) is mounted, the lock core (6) further including a drive block (61) that is pivotable by manual rotation of the turnknob or by a proper key, the drive block (61) being engagable with the second notch (43) of the deadbolt (4) for moving the deadbolt (4).

2. The dual lock assembly as claimed in claim 1, wherein the housing (1) includes a hole (107) through which the safe (7) extends and retracts, a fixing plate (71) being secured to the housing (1) to guide the safe (7) rectilinearly, the safe (7) including an end with a hook (73), a safe piece (74) including a protrusion (75) operably connected to the hook (73), the safe piece (74) including an end pivoted to the housing (1), a fourth elastic element (76) being provided to bias the other end of the safe piece (74) to a position obstructing retraction of the latch bolt (3), a fifth elastic element (72) being provided for biasing the safe (7) to move beyond the hole (107) of the housing (1) and for moving the safe piece (74) to a position not obstructing retraction of the latch bolt (3).

3. The dual lock assembly as claimed in claim 1, wherein the housing (1) and the plate (13) include aligned windows (17, 131) to allow detachment and securing of the stop piece (51) of the stop block (5).

4. The dual lock assembly as claimed in claim 1, further comprising an elastic element (23) for returning the upper actuating plates (22) of the drive mechanism (2) after rotation of the upper actuating plates (22).

5. The dual lock assembly as claimed in claim 1, further comprising a post (19) to which the upper actuating plates (22) bear during returning movement of the upper actuating plates (22), thereby ending the returning movement.

6. The dual lock assembly as claimed in claim 2, further comprising a post (19) to which the upper actuating plates (22) bear during returning movement of the upper actuating plates (22), thereby ending the returning movement.

7. The dual lock assembly as claimed in claim 3, further comprising a post (19) to which the upper actuating plates (22) bear during returning movement of the upper actuating plates (22), thereby ending the returning movement.

8. The dual lock assembly as claimed in claim 4, further comprising a post (19) to which the upper actuating plates (22) bear during returning movement of the upper actuating plates (22), thereby ending the returning movement.

9. The dual lock assembly as claimed in claim 1, where in the latch bolt (3) includes an end with a slot (36).

10. The dual lock assembly as claimed in claim 9, further comprising a compressing plate (34) having an end to which the U-shape plate (31) of the latch bolt (3) bears during returning movement of the latch bolt (3), the housing (1) including a pivotal member (104) about which the compression plate (34) pivots, an elastic element (35) being provided for biasing the other end of the compression plate (34) to bear against a stop (105) on the housing (1), the end of the latch bolt (3) having the slot (36) being pushable to make the latch bolt (3) move beyond the latch bolt opening (14), thereby allowing the latch bolt (3) to rotate through 180°.

11. The dual lock assembly as claimed in claim 1, wherein the deadbolt (4) includes a rectilinear slot (42) and wherein the housing (1) includes a peg (102) received in the rectilinear slot (42), thereby guiding the deadbolt (4) rectilinearly.

12. The dual lock assembly as claimed in claim 1, further comprising an elastic element (47) for biasing the deadbolt (4) to extend beyond the deadbolt opening (15).

13. The dual lock assembly as claimed in claim 1, wherein the deadbolt (4) further includes a protrusion (48) to restrain pivotal movement of the follower plate (45) and to allow the other end of the follower plate (45) to retract the latch bolt (3).

14. The dual lock assembly as claimed in claim 1, wherein the stop block (5) includes a protrusion (52) and wherein the housing (1) includes a rectilinear slot (16) for guiding and receiving the protrusion (52).

* * * * *